US010391026B2

(12) United States Patent
Wilkinson

(10) Patent No.: US 10,391,026 B2
(45) Date of Patent: Aug. 27, 2019

(54) BODY DRYER

(71) Applicant: Christopher Wilkinson, Brooklyn, NY (US)

(72) Inventor: Christopher Wilkinson, Brooklyn, NY (US)

( * ) Notice: Subject to any disclaimer, the term of this patent is extended or adjusted under 35 U.S.C. 154(b) by 195 days.

(21) Appl. No.: 15/668,990

(22) Filed: Aug. 4, 2017

(65) Prior Publication Data

US 2018/0036200 A1 Feb. 8, 2018

Related U.S. Application Data

(60) Provisional application No. 62/370,793, filed on Aug. 4, 2016.

(51) Int. Cl.

| | |
|---|---|
| ***A47K 10/48*** | (2006.01) |
| ***A61H 33/06*** | (2006.01) |
| ***A61H 33/08*** | (2006.01) |

(52) U.S. Cl.

CPC ..... *A61H 33/06* (2013.01); *A47K 10/48* (2013.01); *A61H 33/066* (2013.01); *A61H 33/08* (2013.01); *A61H 2033/061* (2013.01); *A61H 2201/5007* (2013.01); *A61H 2201/5046* (2013.01); *A61H 2201/5082* (2013.01); *A61H 2201/5087* (2013.01); *A61H 2203/0406* (2013.01)

(58) Field of Classification Search

CPC ..... A61H 33/06; A61H 33/066; A61H 33/08; A61H 2033/061; A47K 10/48

See application file for complete search history.

(56) References Cited

U.S. PATENT DOCUMENTS

| | | | | |
|---|---|---|---|---|
| 3,128,161 | A * | 4/1964 | Hudon | A47K 10/48 239/587.4 |
| 4,833,739 | A * | 5/1989 | Sakakibara | A61H 33/06 4/524 |
| 5,009,587 | A | 4/1991 | Corvaglia et al. | |
| 5,570,515 | A | 11/1996 | Schulte | |
| 6,681,417 | B2 * | 1/2004 | Brunelle | A61H 33/06 4/524 |
| 6,962,005 | B1 | 11/2005 | Khosropour et al. | |
| 7,900,371 | B1 | 3/2011 | Bullard | |
| 8,438,753 | B2 * | 5/2013 | Martin | A47K 3/281 236/94 |
| 2003/0188378 | A1 | 10/2003 | Brunelle et al. | |
| 2013/0133134 | A1 * | 5/2013 | Faridoon | A61N 5/0625 4/597 |

FOREIGN PATENT DOCUMENTS

| | | | | |
|---|---|---|---|---|
| CN | 2580891 | | 10/2003 | |
| DE | 19635680 | A1 * | 12/1997 | A47K 10/48 |

* cited by examiner

*Primary Examiner* — David J Laux
(74) *Attorney, Agent, or Firm* — Gearhart Law LLC

(57) ABSTRACT

A personal dryer system for efficiently delivering heated air to are enclosed area (such as shower stall or bath tub) for drying the body of an individual after taking a shower, and for other intended uses. The system includes an air blower, air heater, air distribution assembly and air exhaust vent unit with, optional, air pump, all of which are operatively associated with and regulated by a computerized control unit.

14 Claims, 2 Drawing Sheets

BODY DRYER

CLAIM OF PRIORITY

This application claims the priority of U.S. Ser. No. 62/370,793 filed on Aug. 4, 2016, the contents of which are fully incorporated herein by reference.

FIELD OF THE EMBODIMENTS

The field of the embodiment of the present invention relates to a personal dryer system for delivering heated air for drying a body of a person after using a pool, shower, bath, etc. The dryer system can be readily installed in an existing bathing area and used by the user within the confines of; for example, a shower stall or bathtub enclosure.

BACKGROUND OF THE EMBODIMENTS

There is an unmet need for a means of drying off the body of a person after taking a shower, or a means of heating the interior space of a shower stall or bathtub enclosure for the purpose of drying off the walls of the stall or enclosure (without a person inside the enclosure), or serving as a sweating technique (with a person inside the enclosure) for maintaining, enhancing and in many conditions, bringing back health and vigor. A review of the related technologies reveals the following:

U.S. Pat. No. 5,009,587 pertains to an assembly for efficiently supplying heated air to an enclosed area for drying the body of a person after bathing. The assembly has particular application for installation in an existing bathing area with a minimum of remodeling and with virtually all components being installed behind the walls and ceiling of the bathing area. The assembly includes blower means, duct means and heating means of special construction and location so as to more efficiently supply heated air to the bathing area.

U.S. Pat. No. 6,962,005 pertains to a shower dryer system includes a dryer tower with nozzles for directing heated air into a shower enclosure interior. A programmed controller controls the rate of air flow and the temperature of air flow to and through the air nozzles.

U.S. Pat. No. 7,900,371 pertains to a personal dryer apparatus that provides a full personal enclosure. The apparatus can be positioned as chosen, whether next to a shower or bath or apart from. One door of the apparatus may be selectively removed if complete shower-to-apparatus joining is desired, as the apparatus provides opposite entry and exit. The cap design and interior air delivery and air exit designs provide optimal air flow into, through, and out of the apparatus. The spaced apart nozzles provide multi-levels of air delivery. The apparatus provides temperature controlled heated air. The selectively positioned nozzle openings and fan control provide selectively delivered air flow amounts.

U.S. Patent application No. 2003/0188378 pertains to a therapeutic shower enclosure is comprised of a bottom wall, sidewalls a top wall and a door assembly in the sidewalls for access to the enclosure. An air blower is mounted above the top wall in communication with one or more air return orifices in the top wall. An air distribution channel is in communication with the air blower and at least one air injecting orifice is provided in the top wall and communicates with the enclosure. A heater is provided in the air distribution channel for heating convected air therein to a temperature of up to about 75° C. to provide a stream of hot dry air circulating in the enclosure about a person's body standing therein whereby to cause the person's body to transpire and provide a therapeutic effect of shedding toxins through the skin. In combination with the hot dry air treatment there is available a chromotherapeutic and luminotherapeutic light treatment and an ion and ozone generator to inject ions and ozone in the hot dry air stream.

U.S. Pat. No. 5,570,515 pertains to a light weight, portable, and totally self-contained unit for drying footwear, gloves and the like. A motor driven fan is energized by a battery pack by way of a switch to draw in air and through ports in a housing and to direct the air into a Y-divider and through two discharge tubes and into the item requiring drying.

Chinese Application No. CN2580891 pertains to a drying machine. The utility model is composed of an air changing hole arranged on the box body, and a heat blower arranged on the point of the heat blower port. Heat sources can be provided by resistance wires or boilers for the heat blower. The utility model has the advantage of simple structure.

Various systems and methodologies are known in the art. However, their structure and means of operation are substantially different from the present disclosure. The other inventions fail to solve all the problems taught by the present disclosure. At least one embodiment of this invention is presented in the drawings below and will be described in more detail herein.

SUMMARY OF THE EMBODIMENTS

In general, the present invention and its embodiments teach and describe a body warmer and/or dryer for use in a shower setting.

In one of the embodiments there is a system for delivering heated air streams into a shower enclosure, which comprises a heated air source; a conduit, which provides air flow communication between the heated air source to a first panel, having a plurality of spaced air jets, for forming heated air streams directed downward through a second panel, having a plurality of spaced air vents for directing heated air flow into the shower enclosure, which second panel is disposed underneath the first panel and on a top end of the shower enclosure; a computerized control unit disposed on an outside of a shower enclosure door; and an air exhaust unit, which is disposed at a lower section of the shower enclosure and on at least one side of a shower enclosure wall. The heated air source comprises an air intake, an air heater and an air blower, and wherein the air heater and blower are operatively associated with, while independently regulated by the control unit. The control unit comprises a plurality of air-flow sensors, a plurality of temperature sensors, a touch-sensitive switch, a digital display, a CPU and memory. Here, the heated air flow produced by the heated air source flows through the conduit to and through the first panel, prior to flowing through the second panel into an interior of the shower enclosure, and eventually exits through the air exhaust unit out of the shower enclosure.

In another of the embodiments there is a system for delivering heated air streams into a shower enclosure, which comprises a heated air source; a conduit, which provides air flow communication between the heated air source to a first panel, having a plurality of spaced air jets, for forming heated air streams directed downward through a second panel, having a plurality of spaced air vents for directing heated air flow into the shower enclosure, which second panel is disposed underneath the first panel and on a top end of the shower enclosure; a computerized control unit disposed on an outside of a shower enclosure door; and an air exhaust unit, which is disposed at a lower section of the shower enclosure and on at least one side of a shower enclosure wall, and is further connected through a conduit to an air pump, which is also operatively associated with, while independently regulated by the control unit. The heated air source comprises an air intake, an air heater and an air blower, and wherein the air heater and blower are operatively associated with, while independently regulated by the control unit. The control unit comprises a plurality of air-flow sensors, a plurality of temperature sensors, a touch-sensitive switch, a digital display, a CPU and memory. Here, the heated air flow produced by the heated air source flows through the conduit to and through the first panel, prior to flowing through the second panel into an interior of the shower enclosure, and eventually exits by being pumped out from within the interior of the shower enclosure.

In either one of the aforementioned embodiments, the air intake of the heated air source extends from a location outside the shower enclosure to prevent water within the interior of the shower enclosure from reaching the air blower through the air intake.

In yet another of the aforementioned embodiments, an inlet of the air exhaust unit has a filter made of a water-impermeable membrane to allow air from within the interior of the shower enclosure to flow through, while to prevent water from exiting from the exhaust unit.

In yet another of the aforementioned embodiments, the air jets are evenly distributed on the first panel while the second panel of vents is accordingly configured to allow an evenly distribution of heated air flow entering the shower enclosure.

In yet another of the aforementioned embodiments, the air jets are distributed along the perimeter of the first panel while the second panel of vents is accordingly configured to allow heated air entering and flowing through the shower enclosure along the enclosure walls.

In yet another of the aforementioned embodiments, the plurality of air flow sensors and temperature sensors of the control unit are evenly located on a top section of the shower enclosure walls.

In yet another of the aforementioned embodiments, the control unit is associated with the air blower, air heater and air pump, as well as other optional auxiliary equipment with wired connection means and the control unit is powered by AC electricity.

In yet another of the aforementioned embodiments, the control unit is associated with the air blower, air heater and air pump, as well as other optional auxiliary equipment with wireless connection means and the control unit is powered by a plurality of solar battery modules that are disposed on an outside surface of the shower enclosure door.

In general, the present invention succeeds in conferring the following, and others not mentioned, benefits and objectives.

It is an object of the system of the present invention to provide a means of drying off the body of a person after taking a shower, or a means of heating the interior space of a shower stall or bathtub enclosure for the purpose of drying off the walls of the stall or enclosure (without a person inside the enclosure).

It is another object of the system of the present invention to provide a means which serves as a sweating technique, (with a person inside the enclosure) for maintaining, enhancing and in many conditions, bringing back health and vigor.

A further object of the system of the present invention is to provide optimal flow of heated air in specific flow patterns into, through, and out of the shower enclosure.

A yet added object of the system of the present invention is to provide multi-levels of heated air delivery.

And, an object of the system of the present invention is to provide heated air with the temperature well controlled for the intended purposes.

Yet another object of the system of the present invention is to provide selective amounts, flow rates, temperatures and duration of the heated air, as specifically controlled/programed by an individual use, for achieving optimal effects in the intended use of the system of the present invention.

DESCRIPTION OF THE PREFERRED EMBODIMENTS

Figure 1:
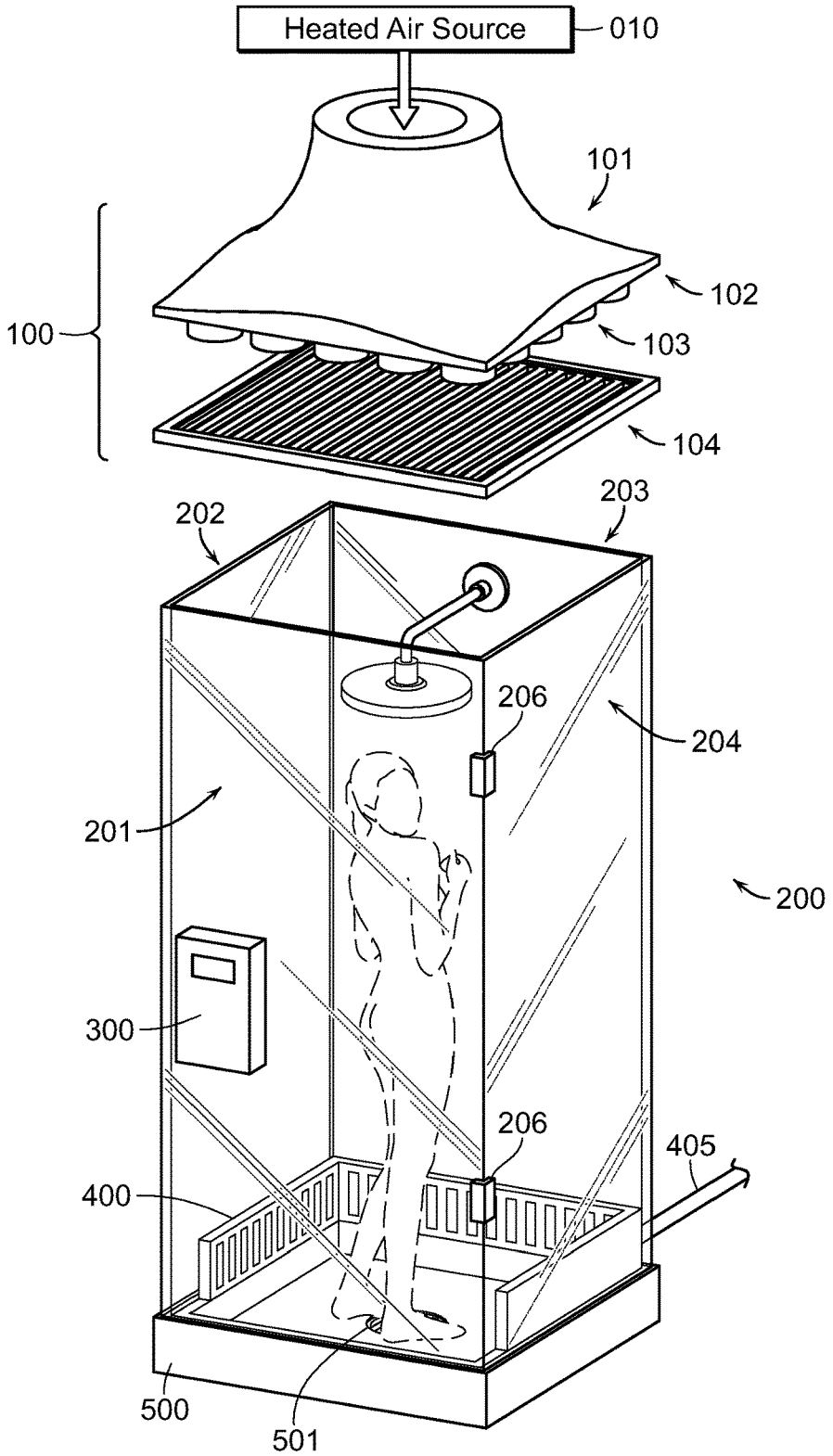
FIG. 1 is a perspective view showing a system of the present invention for delivering heated air streams into a shower enclosure, along with an expanded view of related components for being mounted on the top opening thereof.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring now to FIG. 1, which shows a system of the present invention for delivering heated air streams into a shower enclosure, it partially comprises a source 10 (see below) for generating heated air flow to direct downward through a conduit 101 disposed over a first panel 102 having a plurality of spaced air jets 103, which conduit 101 provides air flow communication between the heated air source 10 and the first panel 102. The first panel 102 with the plurality of air jets 103 thereon is disposed on top of a second panel 104, having a plurality of spaced air vents, which second panel directs heated air flow from the first panel 102 having a plurality of spaced air jets 103 into a shower enclosure 200. The panels, air jets and vents can be manufactured by using various materials, including, but not limited to, Plexiglas® acrylic sheeting, metal (such as aluminum, copper, iron, etc.), and composite materials such as rubber. The panels, air jets and vents can be manufactured by using the same material in the same manufacturing process, or they can be independently manufactured by using different materials in different manufacturing processes and assembled together in a final assembling process.

The entire heated air distribution assembly 100, which consists of the conduit 101, first panel 102 having a plurality of spaced air jets 103 and second panel 104 having a plurality of air vents, is disposed and on a top end of the shower enclosure 200. An inlet of the heated air distribution assembly 100 is operatively connected to the heated air source 10 via air ducts or pipes. The entire perimeter of the connection between the heated air distribution assembly 100 and the shower enclosure 200 should be made substantially air-tight to prevent heated air from escaping before entering the shower enclosure 200, which can be of a variety of cross-sectional shapes, such as triangle, square, rectangle, pentagon, hexagon, octagon, circle, oval, etc. As a result, the perimeter of the heated air distribution assembly 100, and in turn, the perimeters of the conduit 101, first panel 102 and second panel 104 need to be of the same shape as the cross-sectional shape of the shower enclosure 200. Similarly, a base pan 500, which is disposed on a bottom of the shower enclosure 200, need to be of the same shape as well (see below).

In one of the embodiments of the present invention, as shown in FIG. 1, a rectangle-shaped shower enclosure 200 comprises a panel door 201, which is hingedly connected onto a side wall of the shower enclosure 200 via a plurality of hinges 206. The enclosure 200 has an interior space, which is defined by the perimeters of the rectangle-shaped shower enclosure 200, formed by the panel door 201 and three side walls: a first wall 202 spaced apart from a parallel opposing second wall 204 and a third wall 203, which is perpendicularly connecting to a side edge each of both the first wall 202 and second wall 204, while parallel opposing the panel door 201. In this embodiment as shown in FIG. 1, a side edge of the panel door 201 is hingedly connected to a side edge of the second wall 204 via a plurality of hinges 206. A rectangle-shaped base pan 500 is disposed on a bottom end of the shower enclosure 200 and connected to a bottom edge each of the first wall 202, second wall 204 and third wall 203. A water drain 501 is disposed in an approximate center of the base pan 500. Preferably, a non-slip surface is disposed atop the base pan 500.

Disposed above the base pan 500 and alongside at least one of the side walls 202-204 is an air exhaust vent channel 400, which can be face-mounted onto or built into the side walls of the shower enclosure 200. The exhaust lent channel 400 is operatively connected to an exhaust conduit 405 to be further operatively connected to air ducts to direct passively the exhaust air flow away from the shower enclosure 200. An inlet of the air exhaust vent channel 400 has a properly oriented louver cover plate or is fit with a filter of a water-impermeable membrane, such that allowing air to flow from within the interior of the shower enclosure 200 through the air exhaust vent channel 400, while preventing water from exiting therefrom. Overall, the air flow communication in the current embodiment of the present invention is such that the heated air produced by the heated air source 10 flows through the conduit 101 to and through the first panel 102, prior to flowing through the second panel 104 into the interior space of the shower enclosure 200, and eventually exits from within the interior space of the shower enclosure 200 passively through the vent channel 400, exhaust conduit 405 and further through exhaust air ducts.

Figure 2:
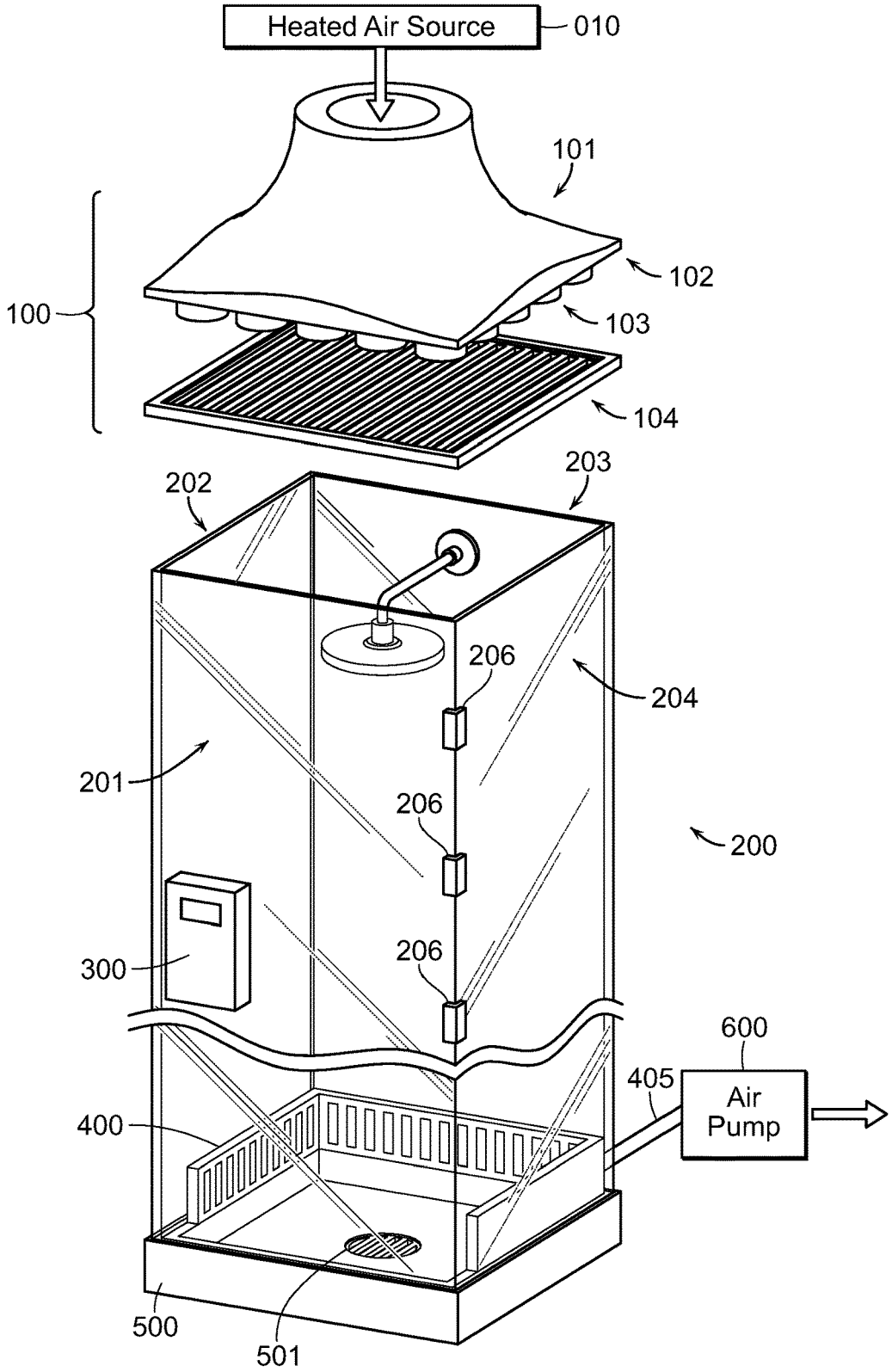
FIG. 2 is a perspective vie showing a system of the present invention for delivering heated air streams into a shower enclosure, with an expanded view of various components for being mounted on the top opening thereof and with the air exhaust.

In another of the embodiments of the present invention, as shown in FIG. 2, the exhaust vent channel 400 is operatively connected to an exhaust conduit 405, which is further operatively connected to an air pump 600 and, in turn, to air ducts so as to actively draw the exhaust air flow away from the shower enclosure 200. Similarly as mentioned above, an inlet of the air exhaust vent channel 400 has a properly oriented louver cover plate or is fit with a filter of a water-impermeable membrane, such that allowing air to flow from within the interior of the shower enclosure 200 through the air exhaust vent channel 400, while preventing water from exiting therefrom. Overall, the air flow communication in this embodiment of the present invention is such that the heated air produced by the heated air source 10 flows through the conduit 101 to and through the first panel 102, prior to flowing through the second panel 104 into the interior space of the shower enclosure 200, and eventually exits by being pumped out from within the interior space of the shower enclosure 200 through the vent channel 400, exhaust conduit 405, air pump 600 and further through exhaust air ducts. The air pump 600 is operatively associated with, while independently regulated by, a computerized control unit 300, which is disposed on an outside of the panel door 201 of the shower enclosure 200, as can be seen with reference to FIG. 1 and FIG. 2

The heated air source employed in the system of the present invention incorporates an air blower which delivers pressurized hot air to air jets 103 on the first panel 102. This is firstly accomplished by the conduit 101 providing air flow communication between the air blower and the air jet. Through the proper use of air ducts, the air blower can be located at a concealed place at a distance away from the inlet of the conduit 101, such as behind a wall adjoining the shower enclosure. Consequently, an air intake for the air blower can extend from a location outside the shower enclosure so that water within the interior of the shower enclosure will not reach the air blower through the air intake. For example, the distal end of the air intake may be located between wall studs adjoining the shower enclosure. The air blower suitable for use in the system of the present invention is equipped with a multi-speed AC blower motor. The air blower is operatively associated with, while independently regulated by, a computerized control unit 300, which is disposed on an outside of the panel door 201 of the shower enclosure 200, as can be seen with reference to FIG. 1 and FIG. 2.

The heated air source employed in the system of the present invention also incorporates a air heater, which may be any suitable conventional electrically operated heater. The heater is for heating flowing air produced by the air blower prior to exit of the flowing air from the heated air source through the conduit 101, first panel 102 having a plurality of air jets 103 and second panel 104 having a plurality of air vents into the interior of the shower enclosure. The air heater is also operatively associated with, while independently regulated by, a computerized control unit 300, which is disposed on an outside of the panel door 201 of the shower enclosure 200, as can be seen with reference to FIG. 1 and FIG. 2.

As shown in FIG. 1 and FIG. 2, the system of the present invention also includes a suitably programmable, microprocessor based control unit 300 which incorporates, and is manually actuated by, a touch-pad and at least one LCD digital display. The control unit 300 is operatively associated with the air blower and the air heater for controlling the rate of air flow to and through the heated air distribution assembly 100 and also for controlling the temperature of the air flowing to and through the heated air distribution assembly 100. In one of the embodiments, the control unit 300 is operatively associated with the exhaust air pump 600 for controlling the rate of air flow out of the shower enclosure 200 through the air vents 400. The touch-pad includes suitable actuator switches allowing the user to make the desired adjustments of air flow rate and air temperature. If the user does not plan to use the dryer, he or she can utilize an off button (not shown).

The control system is operative for controlling the various above-mentioned components of the system of the present invention. The control panel of the control unit 300 is typically in the form of a user interface that allows a user to enter commands for controlling the various operational settings of the system of the present invention. Some non-limiting examples of operational settings of the system of the present invention include heated air temperature control settings, heated air flow rate control settings, exhaust air flow rate control settings and optionally, lighting or other axillary equipment settings.

In a non-limiting embodiment where the shower enclosure 200 of the system of the present invention is also be equipped with thermos-lighting sources, such as IR or halogen light sources, to subject the individual user to intense light with some heating while taking the shower, or to preheat the shower enclosure 200 to a more desirable temperature before the user entering. This light source is typically mounted on the second panel 104, or on the top section of the side walls 202-204. In another non-limiting embodiment where the shower enclosure 200 of the system of the present invention is operatively connected to other functional, e.g., entertainment and/or multimedia, modules, the operational settings of the system of the present invention may also include audio settings and video settings, amongst others. Consequently, the expression "operational settings," for the purpose of the present invention, is intended to cover operational settings for any suitable equipment that can be used by an individual using the shower enclosure 200 of the system of the present invention.

In one of the embodiments of the present invention, the control unit 300 can be connected to the various components of the system of the present, invention with electrical wires. In this case, the control unit 300 is able to receive electrical power from an electric power source that is also connected to the various components the control unit controls. The control unit 300 is then able to, in part, control the distribution of power supplied to the various components of the system of the present invention on the basis of control signals received from a plurality of temperature, air flow and other sensors that are disposed evenly in various locations on a top wall section of the shower enclosure 200 of the system of the present invention, as well as commands from the control panel in order to cause the desired operational settings to be implemented.

In the above-mentioned embodiment, the electrical power source supplies various components of the system of the present invention as well as the control unit 300 with any suitable power service suitable for residential or commercial use, via service wirings. In a non-limiting implementation, the power source can supply 240 volts (V) AC electricity to the controller 30 via service wirings. In an alternative non-limiting implementation, the power source can supply 120 volts (V) AC electricity to the control unit 300 via service wirings. It is to be appreciated that other voltage supply values, for example depending on geographical location, are possible without detracting from the spirit of the invention.

In a preferred embodiment of the present invention, the control unit 300 is connected to the various components of the system of the present invention through the use of various means (protocols) of wireless connection, including, but not limited to, Bluetooth, and the like or a combination thereof.

In this case, the control unit 300 with an appropriate wireless communication module is typically powered and operated by, either a plurality of regular batteries or solar batteries, while a regular electric power source is connected to the various components of the system of the present invention, each of which contains a complementary wireless communication module, through which the component is controlled by the control unit 300. The control unit 300 is thus able to, in part, communicate with the component via the wireless means of connection and control the distribution of power supplied to the various components of the system of the present invention on the basis of control signals received from a plurality of temperature, air flow and other sensors that are disposed evenly in various locations on a top wall section of the shower enclosure 200 of the system of the present invention, as well as commands from the control panel in order to cause the desired operational settings to be implemented.

The above-mentioned embodiment employing a wireless connection strategy is preferred over one employing a wired connection because of, in part, various safety concerns, as the intended implantation location of the control unit 300 is on the panel door 201 which is in a close proximity of water and moisture. As mentioned above, the control unit 300 in an embodiment employing a wireless connection strategy is powered by a plurality of batteries, including solar power modules, and these solar power modules can be disposed on an outside surface of the shower enclosure door to draw sunlight.

In one of the embodiments of the present invention, air jets 103 are distributed along the perimeter of the first panel 102 while the second panel having the plurality of vents accordingly configured to allow heated air entering and flowing through the shower enclosure 200 along the enclosure walls. This embodiment of the system of the present invention is mostly intended for the objective of providing a means for drying an individual's body after taking a shower.

In another of the embodiments of the present invention, air jets 103 are distributed evenly over the first panel 102 while the second panel having the plurality of vents accordingly configured to allow an evenly distribution of the heated air entering and flowing through the shower enclosure 200. This embodiment of the system of the present invention is mostly intended for the objective of providing a means for use as a sweating technique (with a person inside the enclosure 200) for maintaining, enhancing and in many conditions, bringing back health and vigor. In such an embodiment, heated air is convected through the distribution assembly 100 into the enclosure 200 to a temperature of up to about 50° C. to 65° C. to provide a stream of hot dry air circulating in the enclosure 200 about a person's body standing therein. This hot stream of air will cause the person to perspire and provide various therapeutic effects, detailed underlying principles of which can be found elsewhere.

In this case, the control unit 300 can be used to select the desired temperature and time of operation (treatment time) by controlling operations of the air blower and air heater in the heated air source 10. The individual user typically would start using the shower enclosure of the present invention at lower temperatures and progressively increase the temperature and time of exposure depending on his/her tolerance thereto. While not wishing to be bound by theory, the following therapeutic effects may be achieved in this embodiment, depending on the time in which a person is exposed to thermal conditions of hot dry heat. It is believed that the skin can be cleansed by sweating when subjected to dry hot air, while the sinus can be unblocked at the level of the nose canals. It is also believed that one can lose fat by sweating and augmenting the heart rate during the sweating effort. It has also been suggested that when subjecting body to hot dry heat that it has an effect in reducing stress as endorphins are secreted from the brain by the body to counteract pain such as when one is subjected to a fracture. The increase of the internal body temperature may also create a fever to prevent the effect of virus or bacteria that one breathes in the air. Still another beneficial effect to the health has been suggested to be the elimination of various "toxins" accumulated in the body, particularly to those exposed to heavy metals in a working environment, or lead, mercury, B.P.C.s or polychlorinated biphenyl as well as other natural occurring toxins, e.g., mycotoxins which are produced by mushrooms.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A system for delivering heated air streams into a shower enclosure comprising:

a heated air source;

a conduit providing air flow communication between the heated air source to a first panel having a plurality of spaced air jets for forming heated air streams directed downward through;

a second panel having a plurality of spaced air vents for directing heated air flow into the shower enclosure, wherein the second panel is disposed below the first panel and on a top end of the shower enclosure;

a computerized control unit disposed on an outside of a shower enclosure door; and an air exhaust unit, which is disposed at a lower section of the shower enclosure and on at least one side of a shower enclosure wall, wherein the control unit comprises a plurality of air-flow sensors, a plurality of temperature sensors, a touch-sensitive switch, a digital display, a CPU, and memory;

wherein the heated air source comprises an air intake, an air heater and an air blower, and wherein the air heater and blower are operatively associated with, while independently regulated by the control unit; and wherein the heated air flow produced by the heated air source flows through the conduit to and through the first panel, prior to flowing through the second panel into an interior of the shower enclosure, and eventually exits through the air exhaust unit out of the shower enclosure.

2. The system according to claim 1 wherein the air intake of the heated air source extends from a location outside the shower enclosure to prevent water within the interior of the shower enclosure from reaching the air blower through the air intake.

3. The system according to claim 1 wherein an inlet of the air exhaust unit has a filter made of a water-impermeable membrane to allow air from within the interior of the shower enclosure to flow through, while to prevent water from exiting from the exhaust unit.

4. The system according to claim 1 wherein the air jets are evenly distributed on the panel of jets while the panel of vents is accordingly configured to allow an evenly distribution of heated air flow entering the shower enclosure.

5. The system according to claim 1 wherein the air jets are distributed along the perimeter of the panel of jets while the panel of vents is accordingly configured to allow heated air entering and flowing through the shower enclosure along the enclosure walls.

6. The system according to claim 1 wherein the plurality of air flow sensors and temperature sensors of the control unit are evenly located on a top section of the shower enclosure walls.

7. The system according to claim 1 wherein the control unit is powered by a plurality of solar battery modules disposed on an outside surface of the shower enclosure door.

8. A system for delivering heated air streams into a shower enclosure comprising:

a heated air source;

a conduit providing air flow communication between the heated air source to a first panel having a plurality of spaced air jets for forming heated air streams directed downward through;

a second panel having a plurality of spaced air vents for directing heated air flow into the shower enclosure, wherein the second panel is disposed underneath the first panel and on a top end of the shower enclosure;

a computerized control unit disposed on an outside of a shower enclosure door; and an air exhaust unit, which is disposed at a lower section of the shower enclosure and on at least one side of a shower enclosure wall, and is further connected through a conduit to an air pump, which is also operatively associated with, while independently regulated by the control unit;

wherein the heated air source comprises an air intake, an air heater and an air blower, and wherein the air heater and blower are operatively associated with, while independently regulated by the control unit;

wherein the control unit comprises a plurality of air-flow sensors, a plurality of temperature sensors, a touch-sensitive switch, a digital display, a CPU and memory; and wherein the heated air flow produced by the heated air source flows through the conduit to and through the first panel, prior to flowing through the second panel into an interior of the shower enclosure, and eventually exits by being pumped out from within the interior of the shower enclosure.

9. The system according to claim 8 wherein the air intake of the heated air source extends from a location outside the shower enclosure to prevent water within the interior of the shower enclosure from reaching the air blower through the air intake.

10. The system according to claim 8 wherein an inlet of the air exhaust unit has a filter made of a water-impermeable membrane to allow air from within the interior of the shower enclosure to flow through, while to prevent water from exiting from the exhaust unit.

11. The system according to claim 8 wherein the air jets are evenly distributed on the panel of jets while the panel of vents is accordingly configured to allow an evenly distribution of heated air flow entering the shower enclosure.

12. The system according to claim 8 wherein the air jets are distributed along the perimeter of the panel of jets while the panel of vents is accordingly configured to allow heated air entering and flowing through the shower enclosure along the enclosure walls.

13. The system according to claim 8 wherein the plurality of air flow sensors and temperature sensors of the control unit are evenly located on a top section of the shower enclosure walls.

14. The system according to claim 8 wherein the control unit is powered by a plurality of solar battery modules disposed on an outside surface of the shower enclosure door.

* * * * *